US005602803A

United States Patent [19]

Chaut

[11] Patent Number: 5,602,803

[45] Date of Patent: Feb. 11, 1997

[54] CLOCKS WITH UNIQUE TIME DISPLAYS

[76] Inventor: Yaron Chaut, 31 Tel Hai, 52335 Ramat Gan, Israel

[21] Appl. No.: 514,375

[22] Filed: Aug. 11, 1995

[51] Int. Cl.[6] ..... G04B 19/00

[52] U.S. Cl. ..... 368/223; 368/228; 368/77

[58] Field of Search ..... 368/223–239, 368/76–80

[56] References Cited

U.S. PATENT DOCUMENTS

| | | | |
|---|---|---|---|
| 3,635,011 | 1/1972 | Pindell, Jr. et al. | 368/101 |
| 4,428,682 | 1/1984 | Winter | 368/238 |
| 4,659,232 | 4/1987 | Coster et al. | 368/223 |
| 4,995,021 | 2/1991 | Sullivan | 368/233 |
| 5,132,943 | 7/1992 | Davies | 368/21 |
| 5,299,178 | 3/1994 | Belik | 368/223 |
| 5,303,211 | 4/1994 | Yanaka et al. | 368/76 |
| 5,359,578 | 10/1994 | Truni | 368/76 |

*Primary Examiner*—Bernard Roskoski
*Attorney, Agent, or Firm*—Mark M. Friedman

[57] ABSTRACT

Apparatus for the display of time, which includes a support frame and a driven gear having external teeth mounted to the support frame. The apparatus further includes a rigid annular member with internal teeth for engagement with the external teeth of the driven gear.

5 Claims, 19 Drawing Sheets

Ratio 1:3

Ratio 1:4

Ratio 1:6

CLOCKS WITH UNIQUE TIME DISPLAYS

FIELD AND BACKGROUND OF THE INVENTION

The present invention relates to clocks and, more particularly, to clocks which display the time in unique and innovative ways.

From nearly the beginning of the civilization, man has been fascinated by time and has created a vast multitude of instruments to keep time and display it.

The early clocks relied on the apparent movement of the sun across the sky to cast a shadow on a sundial. Other early clocks relied on the passage of a fixed amount of water or sand through an opening.

In more recent times, mechanical clocks, driven by weights, springs and/or electrical energy, have been widely used. These mechanical clocks typically feature a clock face which features time demarcations. A number of hands rotatable at different angular velocities about the same axis are mounted over the clock face. One hand rotates so as to indicate the hour, another indicates the minutes while a third might indicate the seconds.

Most recently, these analog clocks have been partially replaced by electronic clocks which feature an electronic digital time display, completely obviating the need for rotating hands.

While there all-electronic digital display clocks are suitable for many purposes, there is considerable feeling that analog clocks, which display the time using a spatial relationship of some type, may be easier to read. There is also a desire to enhance the aesthetic appeal of a timepiece so that the ubiquitous clock becomes nearly an object of art rather than a simple and purely functional instrument.

One approach to the enhancement of the aesthetics of an analog timepiece involves the elimination of the rotating hands. This approach is followed, for example, in U.S. Pat. No. 4,858,209 by the present inventor.

There remains a need, and it would be advantageous to have, additional ways of displaying time using a timepiece, or clock, having no rotating hands.

SUMMARY OF THE INVENTION

According to the present invention, there is provided an apparatus for the display of time, comprising: (a) a support frame; (b) a driven gear mounted to the support frame, the gear having external teeth; and (c) a rigid annular member having internal teeth, the external teeth of the driven gear engaging the internal teeth of the annular member so as to rotate the annular member, the annular member featuring markings representing the time, the position of the markings being the sole indication of the time.

Also according to the present invention, there is provided an apparatus for the display of time, comprising: (a) a support frame; (b) a driven gear mounted to the support frame, the gear having external teeth; and (c) a rigid member having external teeth, the external teeth of the driven gear engaging the external teeth of the rigid member so as to rotate the rigid member, the rigid member featuring markings representing the time, the position of the markings being the sole indication of the time.

Further according to the present invention, there is provided an apparatus for the display of time, comprising: (a) a support frame; (b) a driven gear mounted to the support frame, the gear having external teeth; (c) a first rigid annular member having first member internal teeth, the external teeth of the driven gear engaging the first member internal teeth of the first annular member so as to rotate the first annular member, the first annular member featuring markings representing one division of time; and (d) a second rigid annular member oriented substantially perpendicularly to the first rigid annular member, the second annular member having second member internal teeth, the first member internal teeth of the first annular member engaging the second member internal teeth of the second annular member so as to rotate the second annular member, the second member featuring markings representing another division of time.

Additionally according to the present invention, there is provided an apparatus for the display of time, comprising: (a) a support frame; (b) a first rotatable time indicator plate mounted on the frame; and (c) a second rotatable time indicator plate mounted to the frame, the second plate being oriented relative to the first plate in such a way that the plates have a point of nearest approach to each other, the point of nearest approach being indicative of the time.

Furthermore, according to the present invention, there is provided an apparatus for the display of time, comprising: (a) a support frame; (b) a rotatable time indicator element mounted on the support frame, the element featuring ratchet teeth about a periphery of the element; and (c) a pivotable time indicator member mounted on the support frame, the member located so as to engage the ratchet teeth so as to pivot as the element is rotated, the pivoting of the member serving to at least partly indicate the time.

Yet further according to the present invention, there is provided an apparatus for the display of time, comprising: (a) a support frame; (b) a horizontally rotatable time indicator element mounted on the support frame, the element featuring vertically extending ratchet teeth about a periphery of the element; and (c) a slidable time indicator member mounted on the support frame, the member located so as to engage the ratchet teeth so as to slide as the element is rotated, the pivoting of the member serving to at least partly indicate the time.

Further yet according to the present invention, there is provided an apparatus for the display of time, comprising: (a) a support frame; (b) a rotatable time indicator plate mounted on the support frame, the plate being non-circular; and (c) a slidable time indicator member connected to the support frame and slidable relative to the support frame, the member riding on the plate so as to rise and fall as the plate is rotated.

Finally according to the present invention, there is provided an apparatus for the display of time, comprising: (a) a support frame; (b) a driven gear mounted to the support frame, the gear having external teeth; and (c) a rigid rotatable plate mounted on the support frame having external teeth about a periphery of the plate, the external teeth of the driven gear engaging the external teeth of the plate so as to rotate the plate, the plate featuring markings representing the time, the position of the markings being the sole indication of the time.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of clocks which display the time in unique ways.

The principles and operation of clocks according to the present invention may be better understood with reference to the drawings and the accompanying description.

Figure 1A:
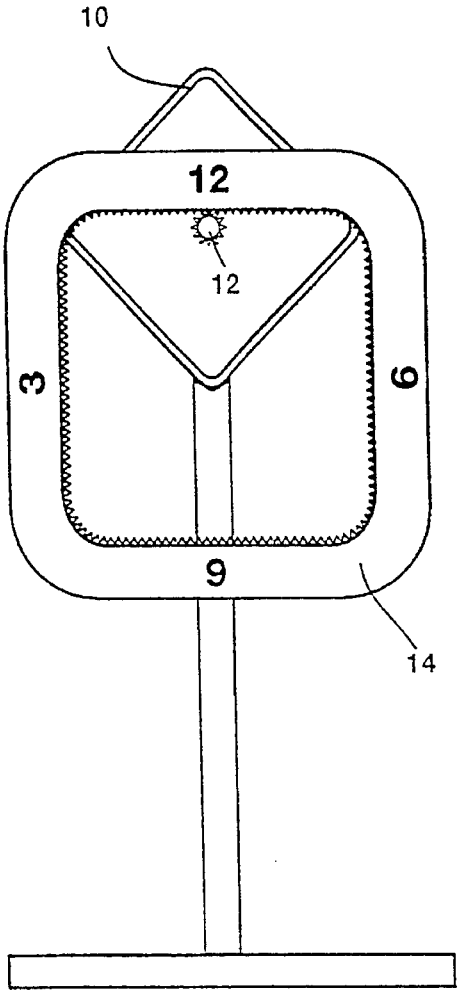
FIGS. 1*a* and 1*b* are front views of one embodiment showing different times, the clock featuring a suspended internally toothed annular time indicator plate.
Figure 1B:
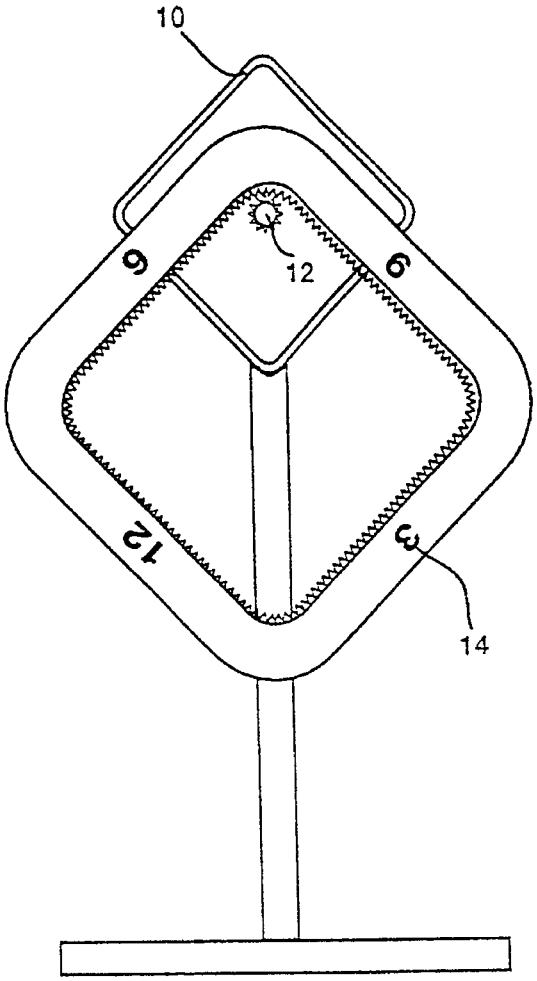

Referring now to the drawings, FIGS. 1*a* and 1*b* illustrates one embodiment of a clock according to the present invention. The clock features a suitable frame 10, which typically houses a motor and other auxiliary components (not shown). Mounted on frame 10 is a driven gear 12. Drive gear 12 is typically driven at some suitable angular velocity by a driver mechanism, such as a motor (not shown). Driven gear 12 features external teeth about its periphery.

The clock further includes a rigid annular member 14 having internal teeth, i.e., teeth around the inward-facing periphery. The external teeth of driven gear 12 engage the internal teeth of annular member 14 so as to rotate annular member 14. Annular member 14 features markings representing the time. The relative position of these markings relative to some fixed point, such the point of contact of annular member 14 with driven gear 12 being the sole indication of the time. Thus, if we assume, for example that the time is indicated at the point of contact between driven gear 12 and annular member 14, then the time indicated in FIG. 1*a* is approximately 12:00 while the time indicated in FIG. 1*b* is approximately 7:30. Various markings may be used on the face of annular member 14. If desired, both faces of annular member 14 may be marked so as to present the same or different displays to the front and to the back or to allow the display presented to the front to be switched by simply reversing annular member 14.

Figure 3:
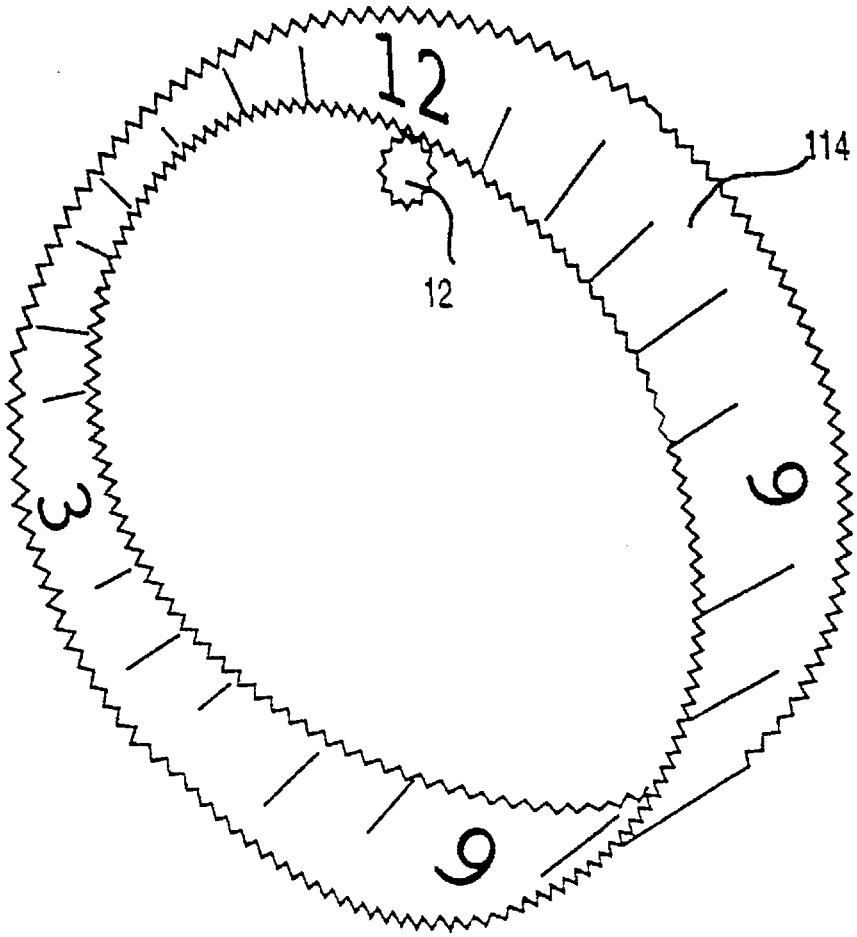
FIG. 3 shows an embodiment featuring an annular time indicator plate in the form of a Moebius strip.

Annular member 14 may take on a virtually limitless variety of shapes, including, but not limited to, various polygonal shapes. As a further example, annular member 114 may be in the form of a Moebius strip, as illustrated in FIG. 3. In this case annular member 114 features teeth on both sides since both sides are, in a sense, a single side.

Figure 2C:
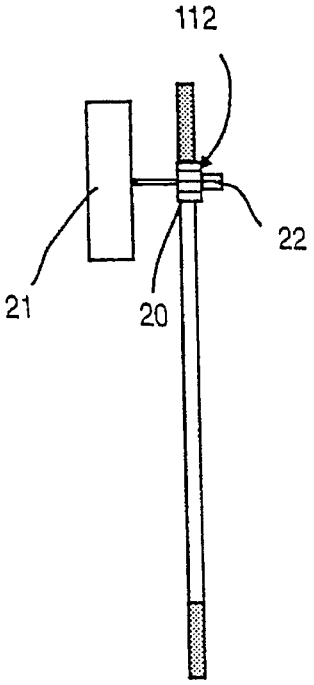
FIGS. 2*a*, 2*b* and 2*c*, 2*d* are two front views and two side views, respectively, of another embodiment featuring a drive gear which features gear teeth of two different diameters.
Figure 2A:
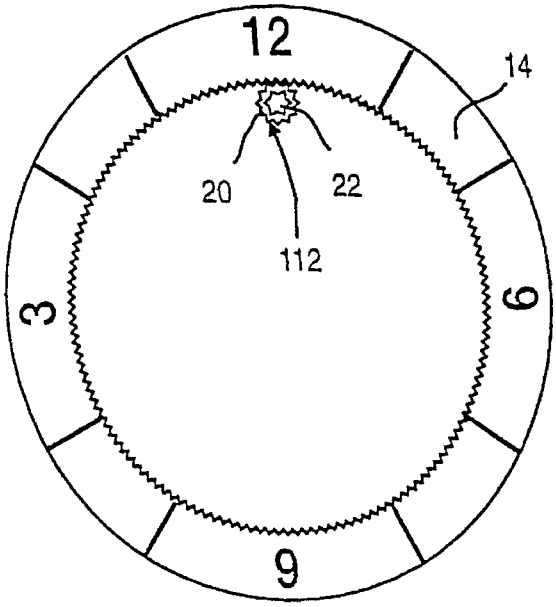
Figure 2D:
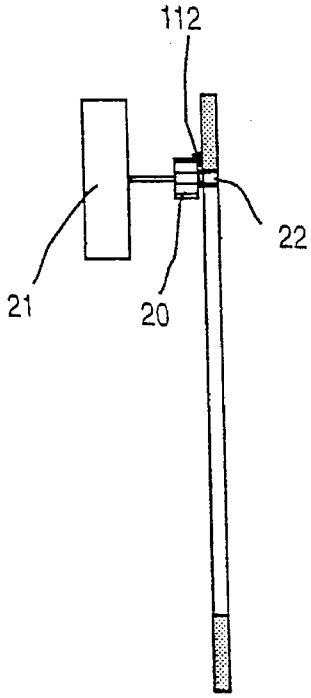
Figure 2B:
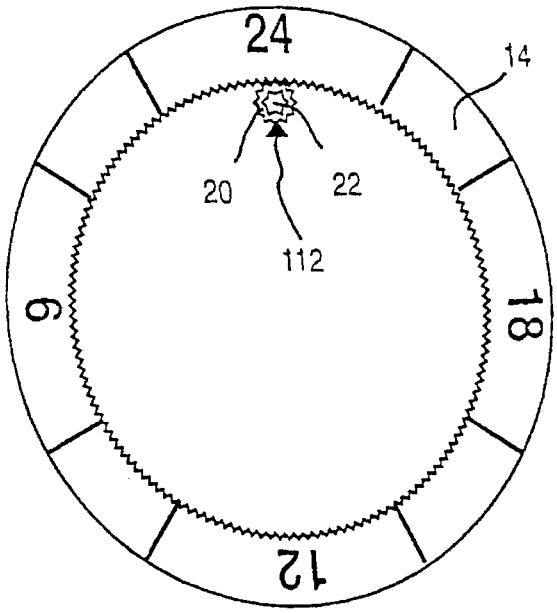

In the embodiment shown in FIGS. 2*a*–2*d*, driven gear 112 includes two or more rigidly connected, or integrally formed, portions of different diameters, with each of the portions dimensioned to accommodate annular member 14. For example, driven gear 112 shown in FIGS. 2*a*–2*d* includes a larger diameter portion 20 and a smaller diameter portion 22. In the example shown, the ratio of the diameters of the two different diameter portions approximately 2:1. Thus annular member 14, when suspended from smaller portion 22, will rotate twice as slow as when suspended from larger portion 20. This makes it possible, for example, to use either a 12-hour display (FIG. 22*a*) or a 24-hour display (FIG. 2*b*). The two displays may actually be effected on opposing faces of the same annular member 14.

Figure 4A:
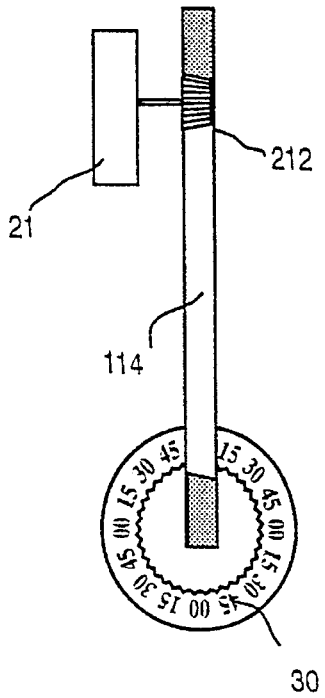
FIG. 4*a* and 4*a* are two side views, from two different sides, of an embodiment featuring a pair of interacting annular time indicator plates.
Figure 4B:
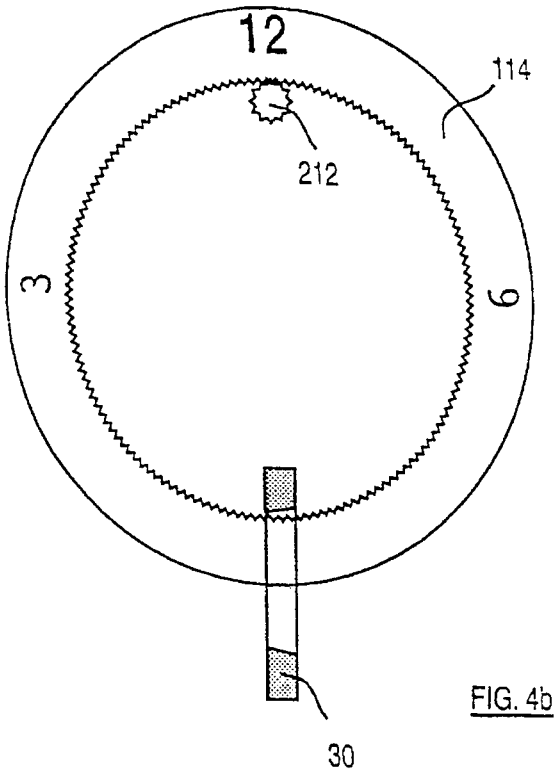

Another variation of a clock according to the present invention is depicted in two side views in FIGS. 4*a* and 4*b*. Here, annular member 114 is again suspended from driven gear 212 as in FIG. 1*a* and 1*b*, but, unlike the earlier described configurations, the clock of FIGS. 4*a* and 4*b* features a secondary member 30 which is of a smaller diameter than annular member 114. Secondary member 30 is internally toothed and is oriented substantially perpendicular to annular member 114. The internal teeth of annular member 14 and secondary member 30 engage each other so as to rotate said secondary member 30, said secondary member 30 featuring markings representing another division of time, such as minutes, for example.

Thus, for example, annular member 114 could display the hours, similar to the configuration of FIGS. 1*a* and 1*b*, while secondary member 30 could display the minutes. The ratio of the teeth of annular member 114 and secondary member 30 is selected to ensure that secondary member 30 rotates with the proper angular velocity relative to that of annular member 114. For example, in FIGS. 4*a* and 4*b* secondary member 30 indicates four hours in 15 minutes intervals so that the angular velocity of secondary member 30 is three times that of annular member 14, so that for every rotation of annular member 114 secondary member 30 makes three rotations.

Figure 5:
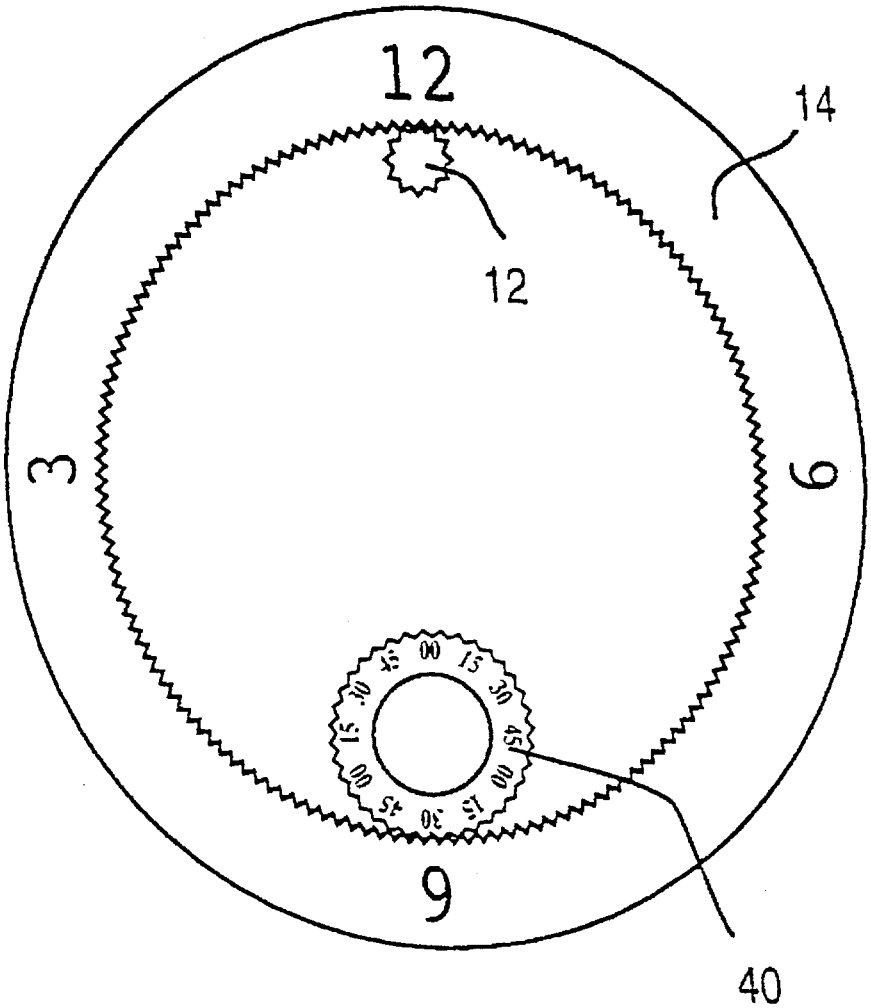
FIG. 5 shows a front view of an embodiment featuring two interacting rings, with the larger ring being suspended on a drive gear.
Figure 5A:
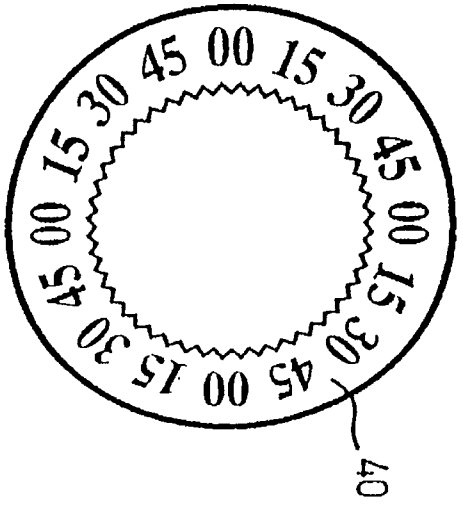
FIGS. 5*a*, 5*b* and 5*c*show three illustrative examples of the rotatable plate of FIG. 5, showing ratios of 1:3, 1:4 and 1:6.
Figure 5B:
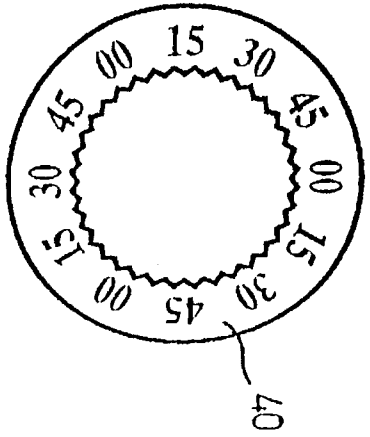
Figure 5C:
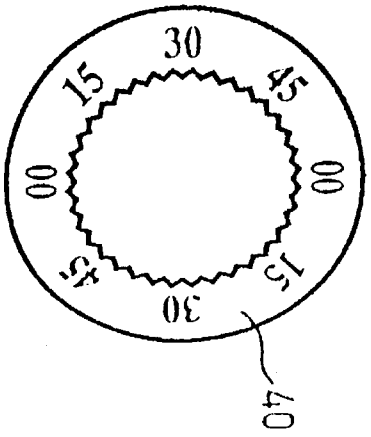

In another embodiment according to the present invention, depicted in FIG. 5, the clock is as in FIGS. 1*a* and 1*b* but further includes a rotatable plate 40 having external teeth which engage the internal teeth of annular member 14. The rotation of driven gear 12 thus rotates annular member 14 which, in turn, rotates rotatable plate 40. Preferably, annular member 14 features hour markings while rotatable plate 40 features minute markings, as shown in FIG. 5. The ratio of the sizes of the annular member 14 and rotatable plate 40 determines the ratio of the angular velocities of the two members. Thus, for example, if the ratio of the diameters is 1:3 (FIG. 5*a*) then rotatable plate 40 will make three full rotations per 12-hour period, with each rotation representing a four-hour span. Similarly, if the ratio of the diameters is 1:4 (FIG. 5*b*) then rotatable plate 40 will make four full rotations per 12-hour period, with each rotation representing a three-hour span. The face of rotatable plate 40 could thus be marked 00-15-30-45-00-15-30-45-00-15-30-45-00, with the last '00' being the first '00', as shown in FIG. 5*b*. FIG. 5*c* shows the situation with a ration of 1:6. Here, rotatable plate 40 will make two six rotation per 12-hour period, with each rotation representing a two-hour span.

Figure 6B:
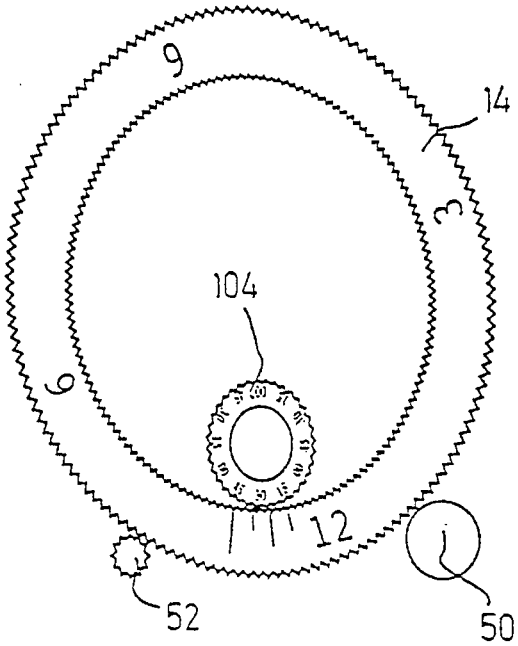
FIGS. 6*a*–6*f* are views of embodiments similar to that of FIG. 5.
Figure 6A:
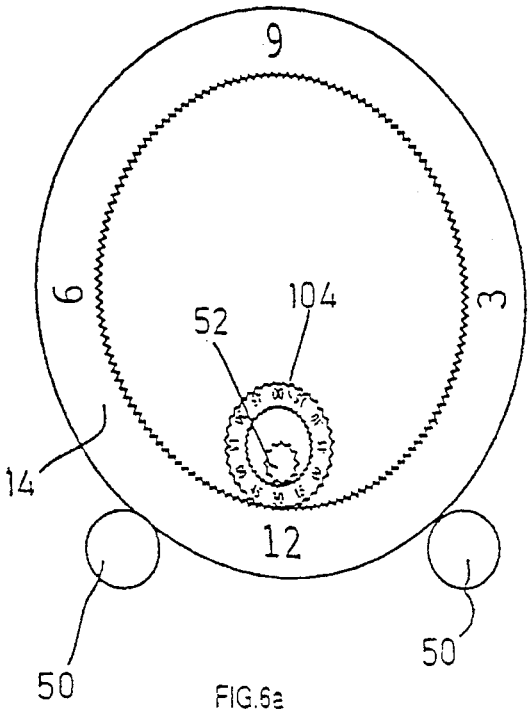

Similar configurations to those shown in FIG. 5 are shown in FIGS. 6*a*–6*f*. In FIGS. 6*a*, unlike the configuration of FIG. 5, annular member 14 is not suspended from a driven gear. Rather, annular member 14 rests on a pair of passive wheels 50 and is driven indirectly by a driven wheel 52. Annular member 14 is internally toothed. Resting on the bottom inner edge of annular member 14 is a secondary plate 104, which is depicted in FIG. 6*a* as being annular. Secondary plate 104 is both externally and internally toothed, with the external teeth for engagement with the internal teeth of annular member 14 and the internal teeth for engagement with a driven gear 52. Preferably, driven gear 52 is hidden from direct view by a ball (not shown) which is allowed to rotate freely on the bottom internal edge of secondary plate 104.

FIG. 6*b* shows another version of the clock of FIG. 6*b*. Here, annular member 14 is internally and externally toothed and rests on both a passive wheel 50 and a driven gear 52, the latter imparting the force to rotate annular member 14.

Figure 6D:
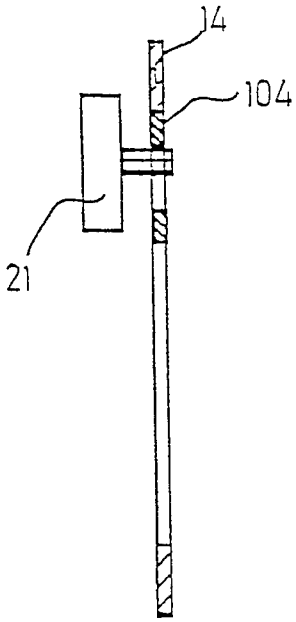
Figure 6C:
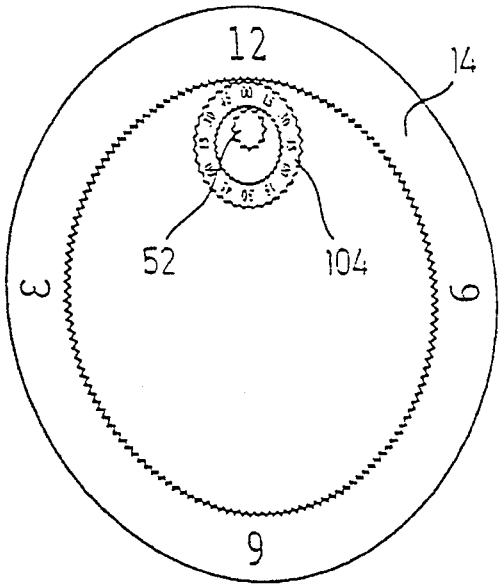

Shown in FIGS. 6*c* and 6*d* are front and side views, respectively, of a clock similar to that shown in FIG. 6*a* but with driven gear 52 being used to rotate and suspend secondary plate 104 which, in turn, rotates and suspends annular member 14.

Figure 6F:
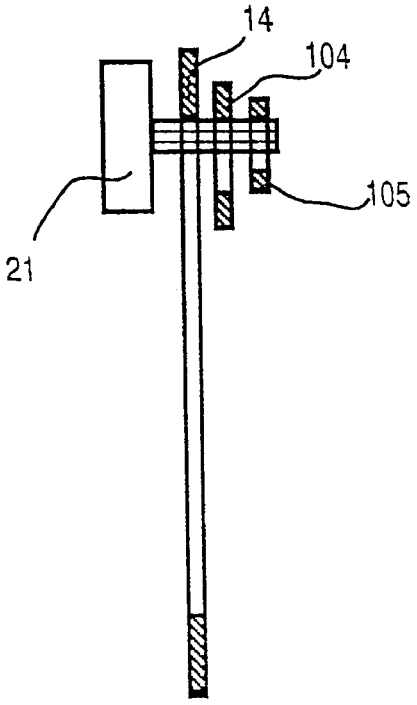
Figure 6E:
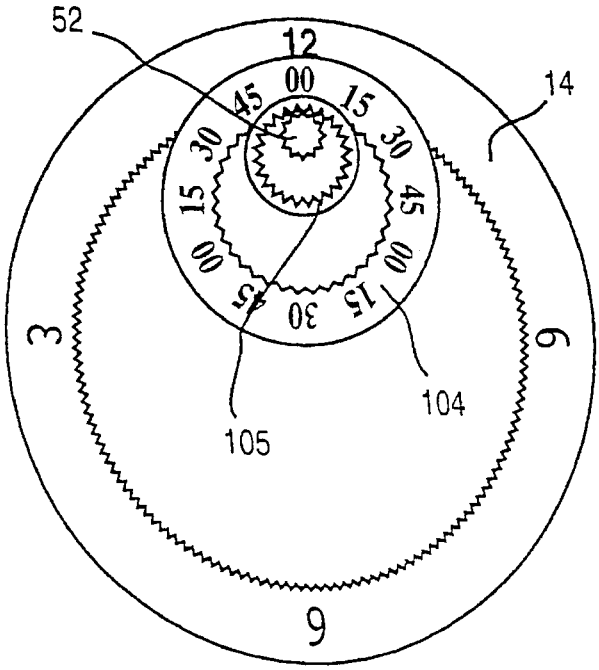

Another version of the clock which is similar to that depicted in FIGS. 6*c* and 6*d* is shown in front and side views, respectively, in FIGS. 6*e* and 6*f*. Here, a single driven gear 52 directly supports and rotates a number of time indicators. Thus, driven gear 52 supports and rotates annular member 14, secondary plate 104 and tertiary plate 105. Tertiary plate 105, may, for example, be used to indicate seconds, and the like.

Further embodiments of clocks according to the present invention are depicted in FIGS. 7–10. In each case, the clock includes a rotatable plate 60, which may or may not be annular and may or may note be circular, having external teeth. A driven gear 52 brings about the rotation of rotatable plate 60. One or more passive wheels 50 may be used to provide support.

Figure 7:
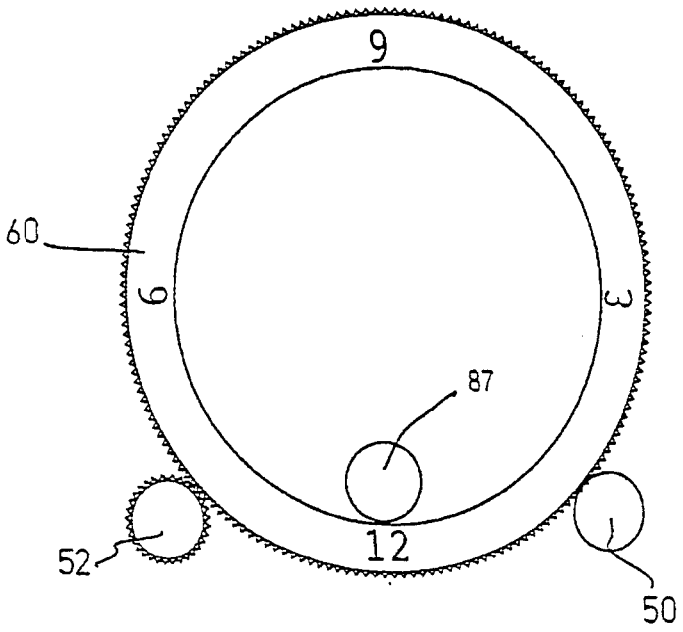
FIG. 7 is a front view of an embodiment wherein the time indicator plate is cradled rather than being suspended.

Thus, in FIG. 7, driven gear 52 rotates rotatable plate 60 which also rests on passive wheel 50. A secondary passive wheel 87 is used to guide rotatable plate 60 and keep it in the path.

Figure 8:
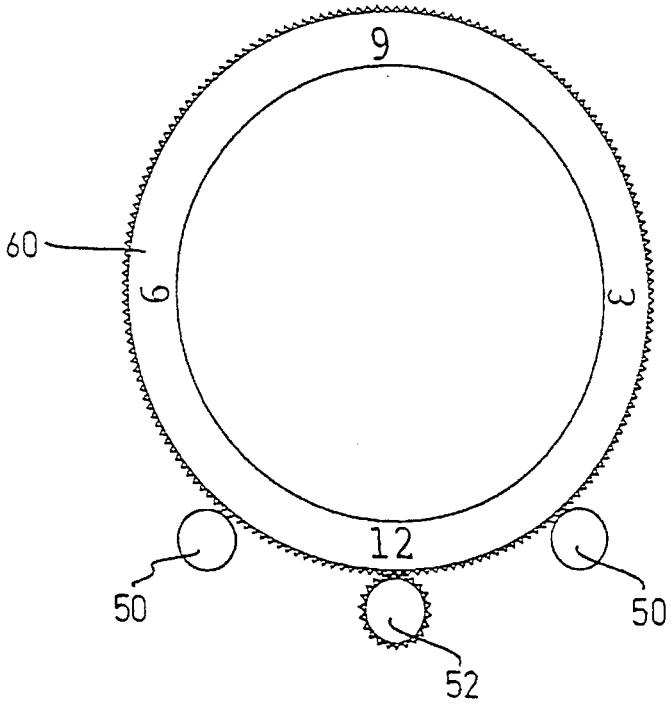
FIG. 8 is a variation of the cradled clock of FIG. 7.

In FIG. 8, rotatable plate 60 is driven by driven gear 52 and rests on a pair of passive wheels 50.

Figure 9:
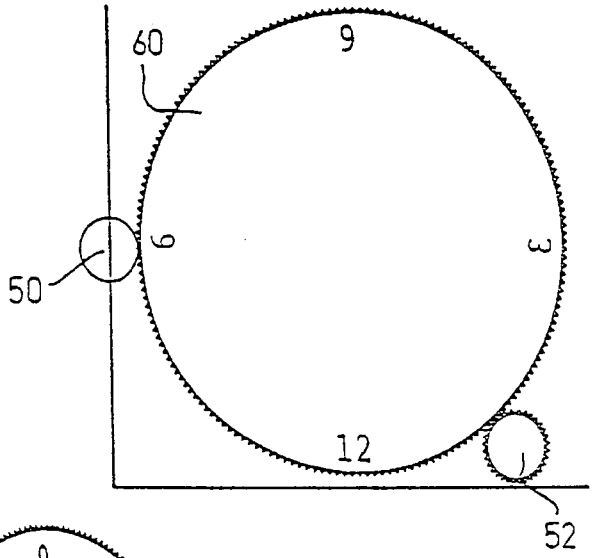
FIG. 9 is another variation of the cradled clock of FIG. 7.

In FIG. 9 is shown a configuration which utilizes a single drive gear 52 and a single passive guide wheel 50 supported in a substantially vertical portion of the support frame.

Figure 10A:
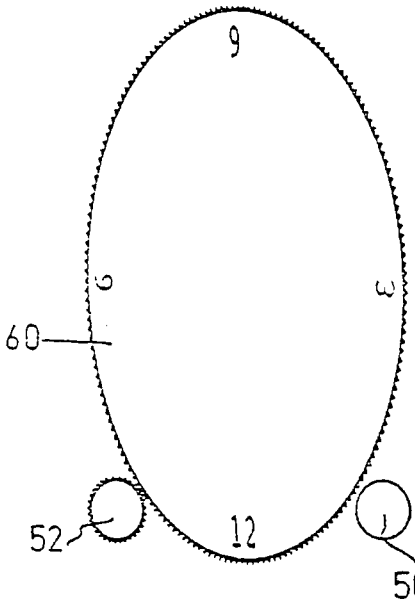
FIGS. 10*a*–10*c* are yet further variations of the cradled clock of FIG. 7.
Figure 10B:
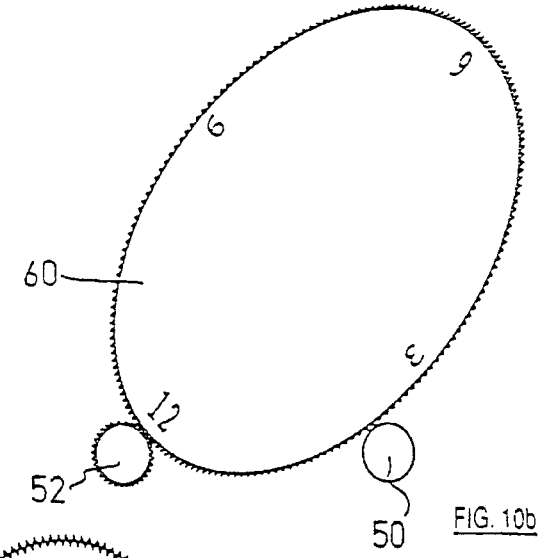
Figure 10C:
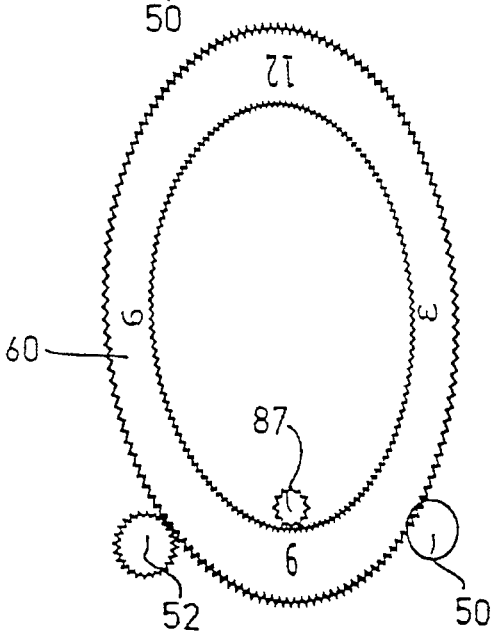

Rotatable plate 60 may take on various shapes, including but not limited to, circular (FIGS. 7–9) and ellipsoidal (FIGS. 10*a*–10*c*). The configurations shown in FIGS. 10*a*–10*c* are similar to those of FIGS. 7–9 but use an ellipsoidal rotatable plate 60 which creates a different visual effect as the ellipse is rotates.

Figure 11A:
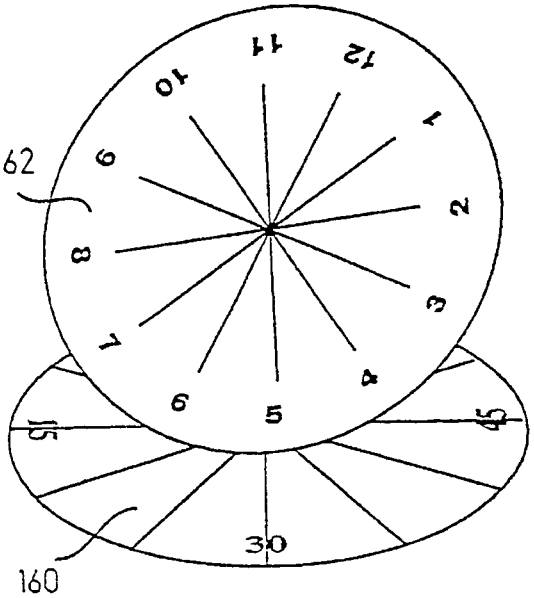
FIGS. 11*a*–11*d* are views of an embodiment featuring a pair of indicator plates which approach or touch at a point.
Figure 11B:
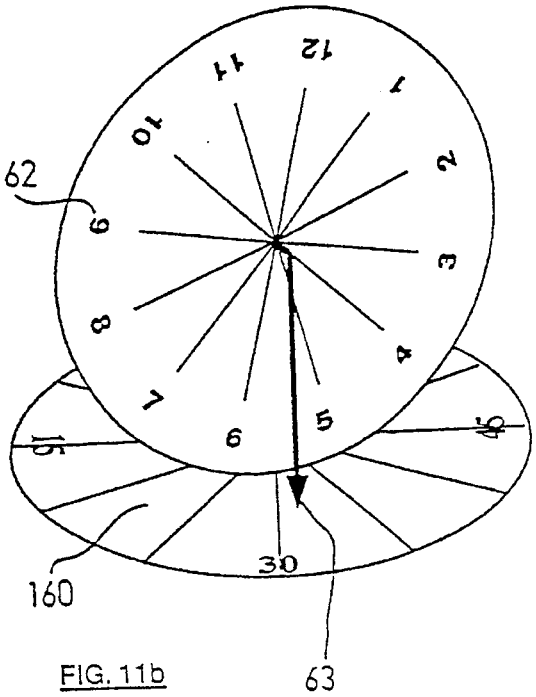
Figure 11C:
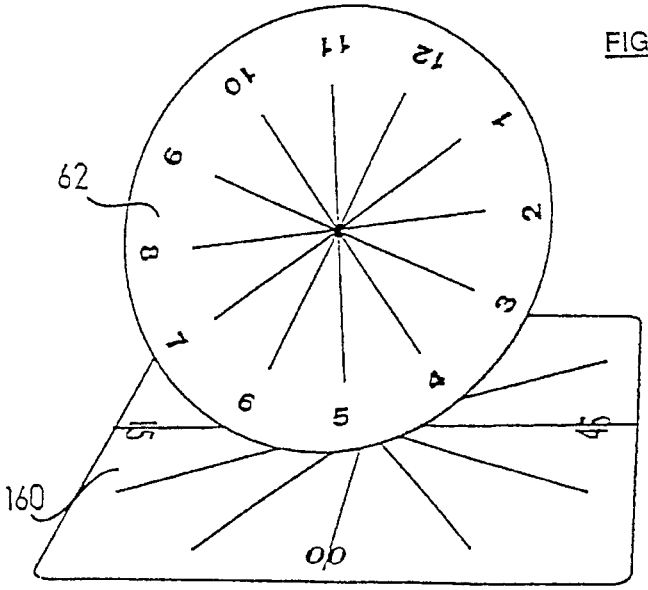
Figure 11D:
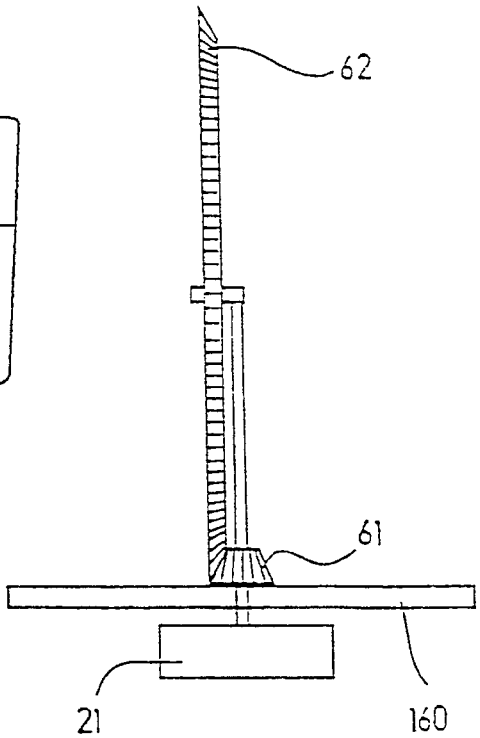

Several versions of another embodiment of clocks according to the present invention is shown in FIGS. 11*a*–11*d*. The clock includes a first rotatable time indicator plate 160 which is mounted on the frame. The clock further includes a second rotatable time indicator plate 62 which is mounted to the frame and which is oriented relative to first plate 160 in such a way that the plates have a point of nearest approach to each other so that the point of nearest approach is indicative of the time. In the case of the configuration of FIG. 11*a* the time can be read directly from the point of nearest approach of the time indicator plates. In the case of FIG. 11*b* a plumb 63 which hangs down from second rotatable indicator plate 62 is used to aid in reading the time. FIG. 11*c* demonstrates that first plate 160 need not be circular. Shown in FIG. 11*d* is a side view of the clock of FIGS. 11*a* or 11*c* showing how a gear connected to first plate 160 can be used to rotate an externally tooth second plate 62.

Shown in FIG. 12–17 are several versions of another embodiment according to the present invention. In each case a rotatable time indicator 70 is mounted on a support frame. Time indicator 70 features ratchet teeth about its periphery. A pivotable time indicator 72 is pivotally mounted on support frame and is located so as to engage the ratchet teeth. As rotatable time indicator 70 rotates about a driven central axis, the angular position of pivotable time indicator 72 changes. The changed angular position is used to partially indicate the time. Thus, for example, in FIG. 12, the time indicator 70 is 12:00 while in FIG. 13 the indicated time is somewhere approximately 12:30.

Figure 12:
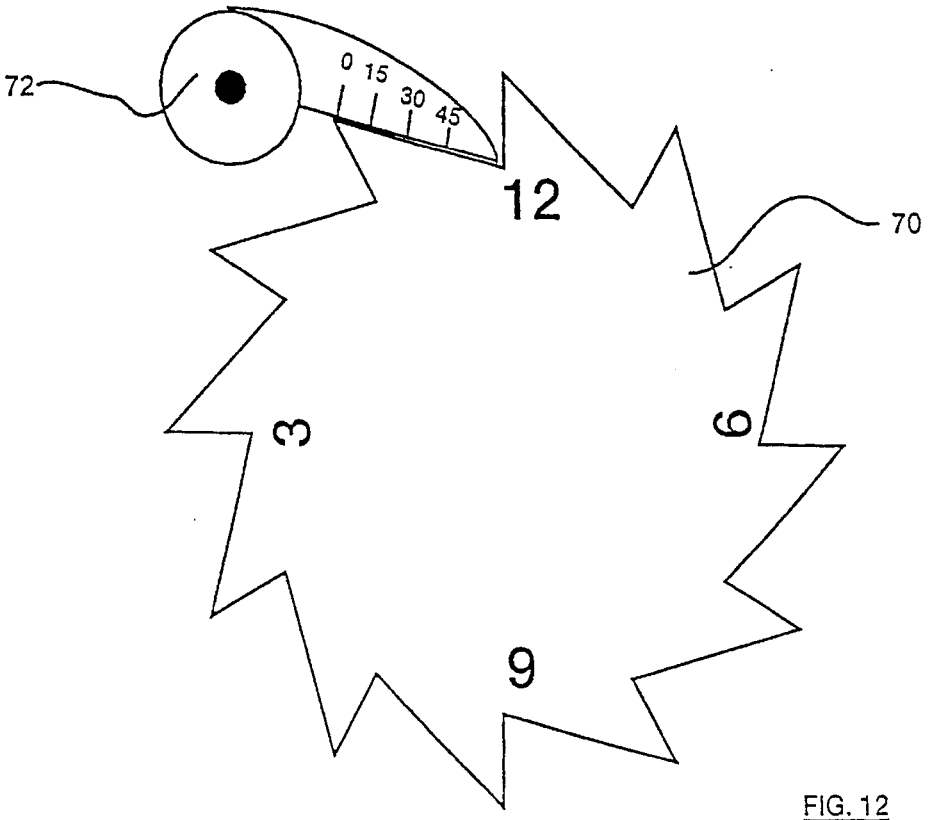
FIG. 12 is a front view of an embodiment using a ratcheted time indicator plate.
Figure 13:
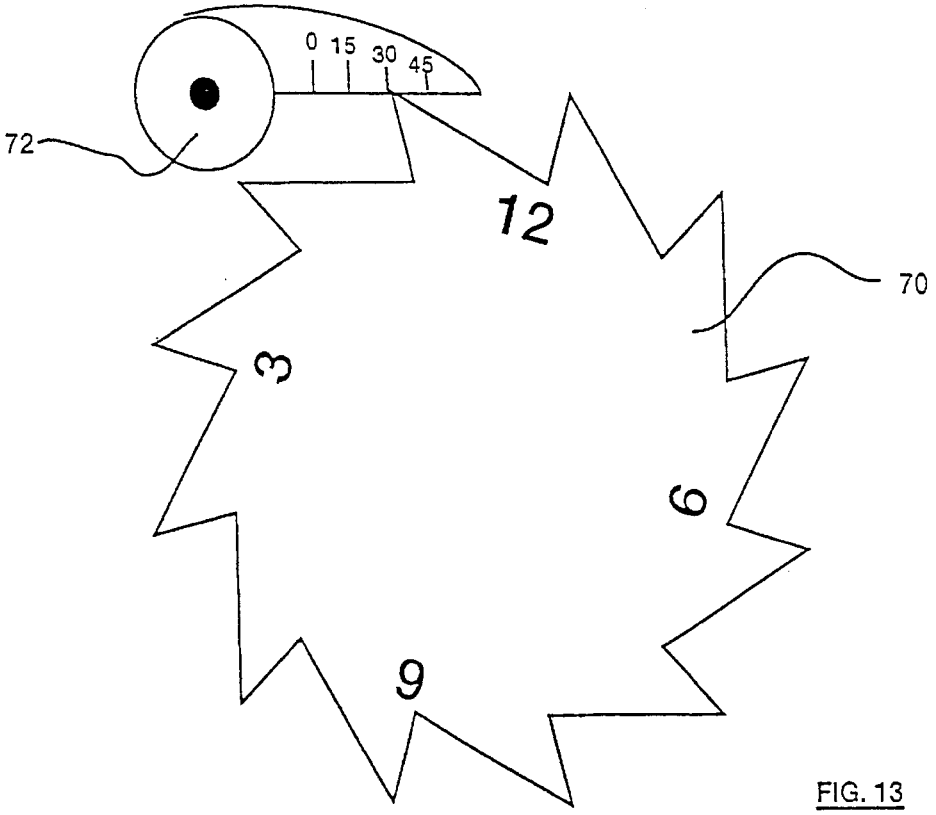
FIG. 13 is a front view of a clock as in FIG. 12 but displaying a different time.
Figure 14:
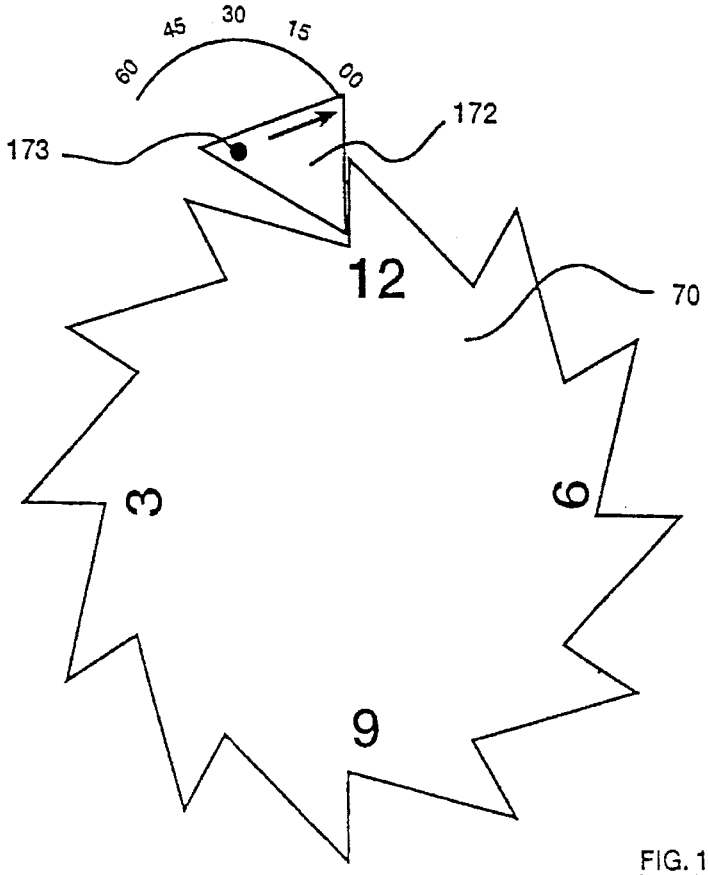
FIG. 14 is a front view of another ratcheted clock featuring a minute dial plate.
Figure 15:
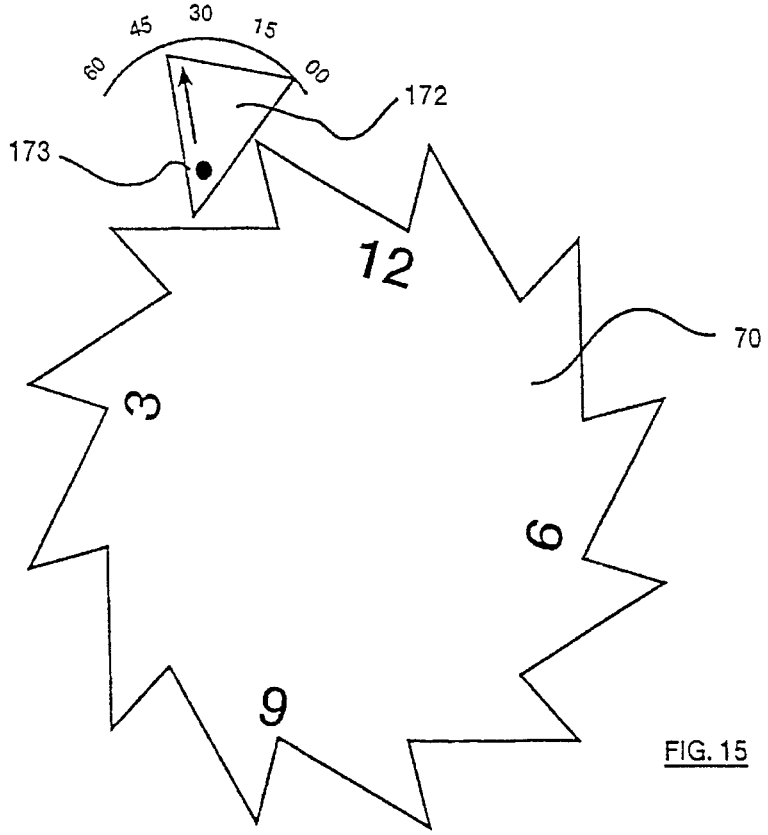
FIG. 15 is of the clock of FIG. 14 but displaying a different time.

Another variation of the clock of FIGS. 12 and 13 is shown in FIGS. 14 and 15. Here a dial plate is fixed to the support frame and the rotatable time indicator 172 is in the form of a pointer which indicated the hours. Rotatable time indicator 172 is pivotable about a pivot point 173. Thus, for example, in FIG. 14 the indicated time is 12:00 while in FIG. 15 the indicated time is approximately 12:40.

Figure 16:
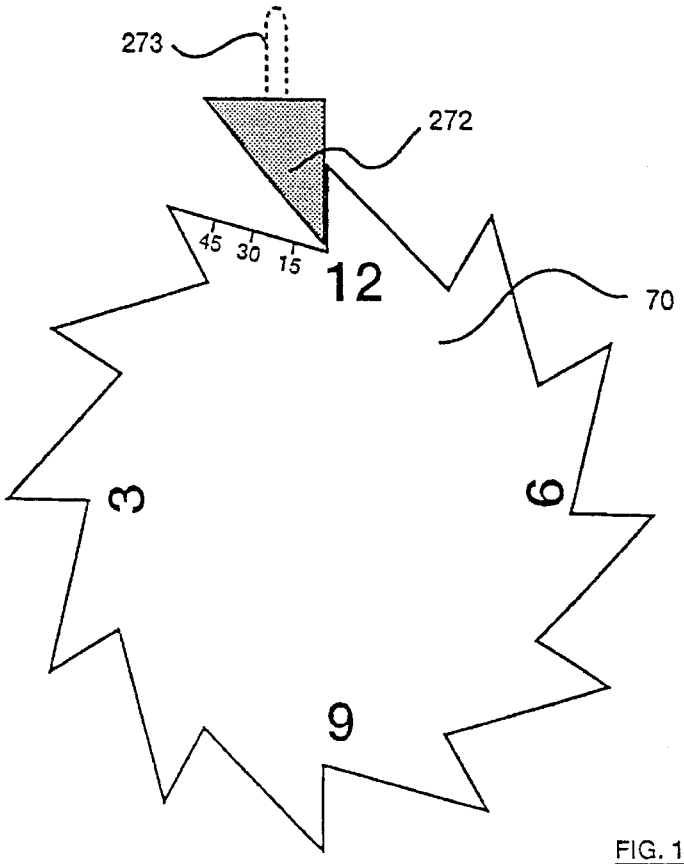
FIG. 16 is a front view of yet another ratcheted clock featuring a minute dial plate.
Figure 17:
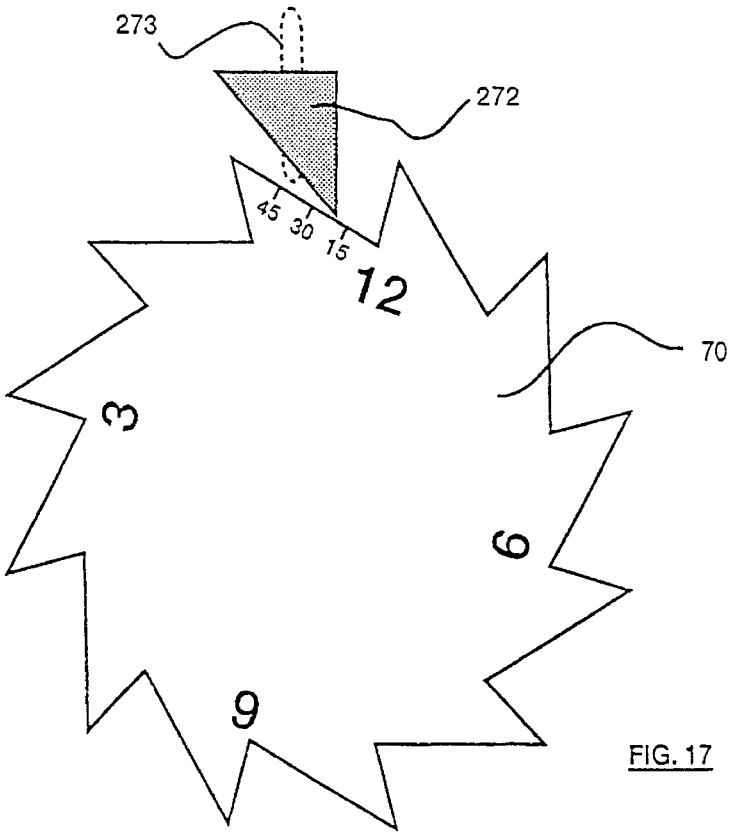
FIG. 17 is of the clock of FIG. 16 but displaying a different time.

Yet another variation is shown in FIGS. 16 and 17. Here, a wedge-like pointer 272 is used to slide up and down relative to the support frame through a slot 273 so as to point to time indications located on time indicator 70.

Figure 18:
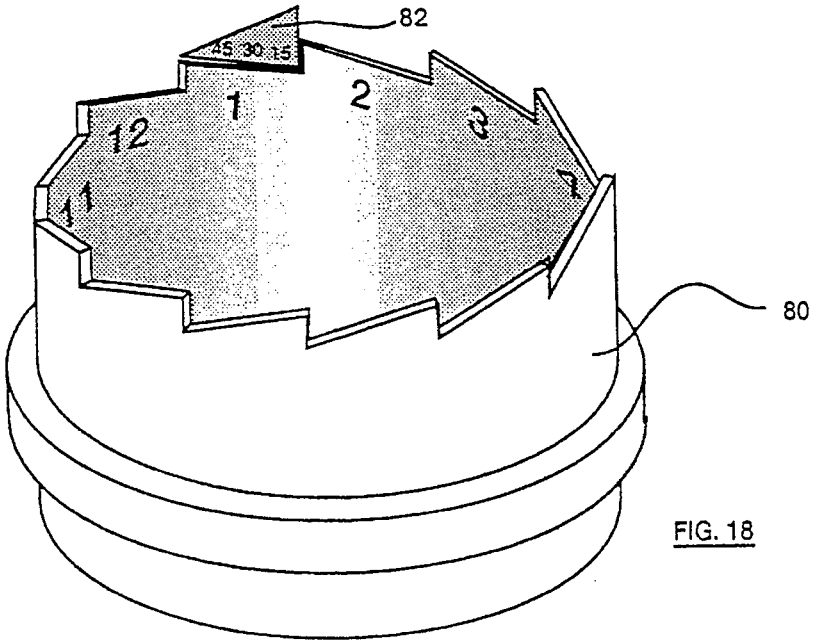
FIGS. 18 and 18*a* are perspectives views of a ratcheted clock with a three-dimensional time indicator 'plate' showing different times with FIG. 18*b* showing an isolated view of the a portion of the time indicating mechanism.
Figure 18A:
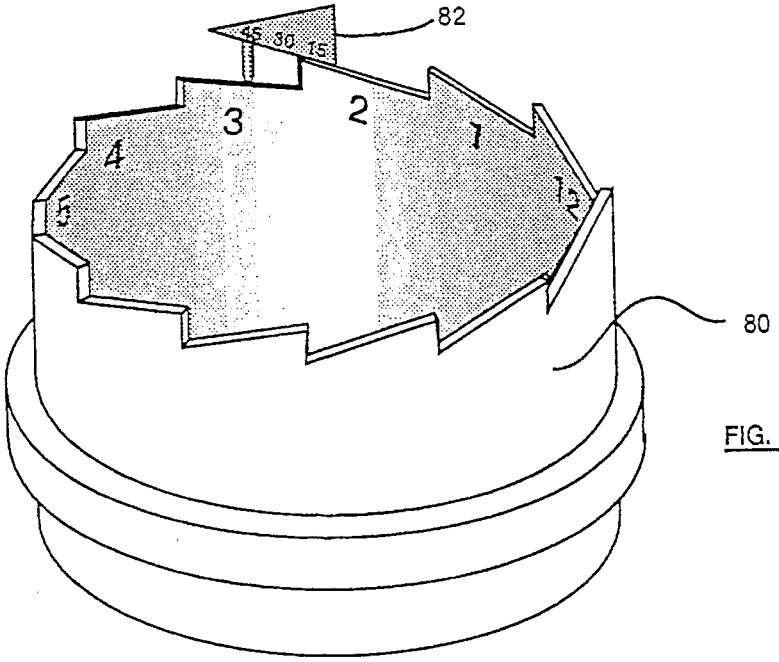
Figure 18B:
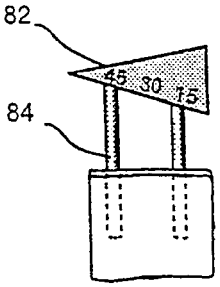

Shown in FIGS. 18 and 18*a* is a three-dimensional version of the clock of FIGS. 16 and 17. Here, a horizontally rotatable time indicator element 80 is mounted on, and rotates relative, the support frame. Time indicator element 80 features a series of vertically extending ratchet teeth about its periphery. The device further includes a slidable time indicator member 82 (shown in close-up in FIG. 18*b*) which is mounted on the support frame in such a way that it is able to slide up and down, typically along a pair of slide rods 84, as a ratchet tooth pushes the slidable portion of slidable time indicator member 82. Each of the ratchet teeth can indicate a particular hour while the vertical position of slidable time indicator member 82 can be used to indicate the fractions of hour.

Figure 19:
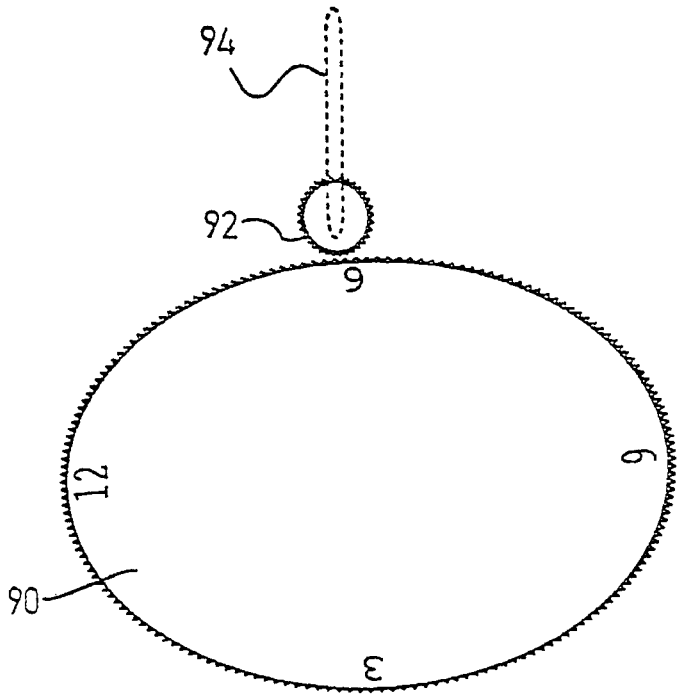
FIGS. 19 and 19*a* are front views of a caromed clock showing different times.
Figure 19A:
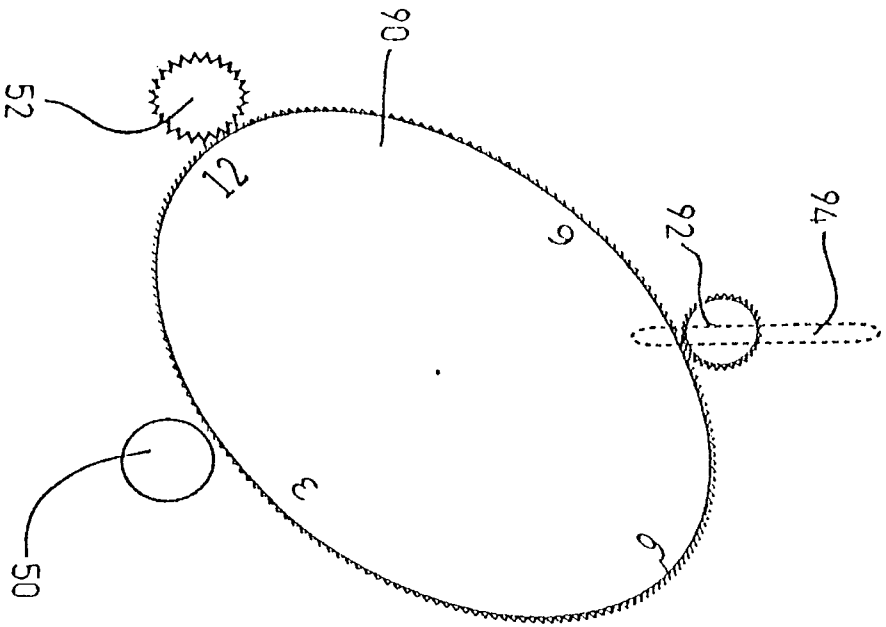

A somewhat similar device is shown in FIGS. 19 and 19*a*. Here, a non-circular, preferably elliptical, rotatable time indicator plate 90 is mounted on a support frame. A slidable time indicator member 92 which is connected to the support frame and which is slidable relative to the support frame rides on time indicator member 92 so as to rise and fall as member 92 is rotated. A slot 94 formed in the support frame accommodates the sliding of time indicator member 92. In the embodiment of FIG. 19 plate 90 is rotated about its axis (not shown) which is connected to the center of plate 90. In the embodiment of FIG. 19*a* driven gear 52 rotates plate 90 and a passive wheel 50 helps support plate 90.

Figure 20A:
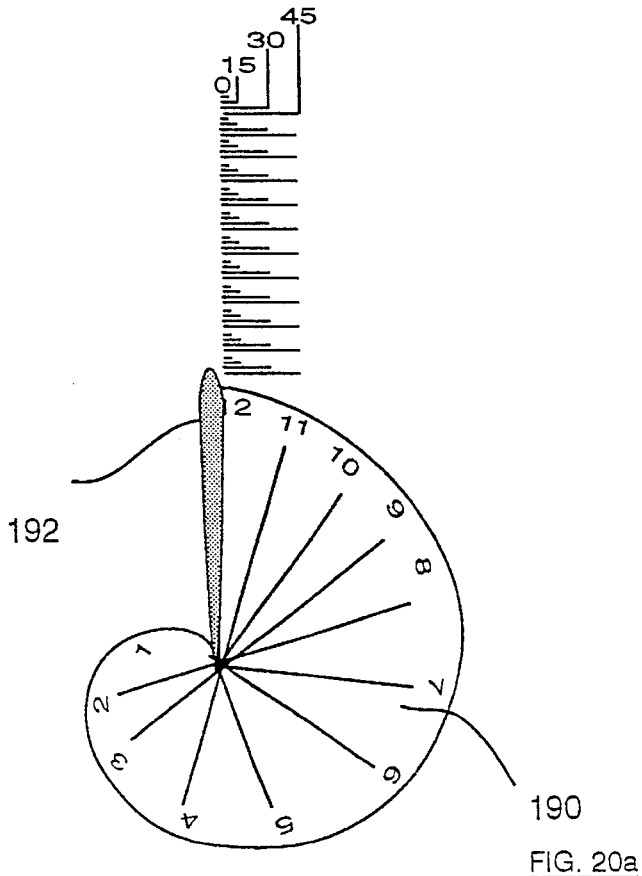
FIGS. 20*a* and 20*b* are front views of two more variations of a cammed clock.
Figure 20B:
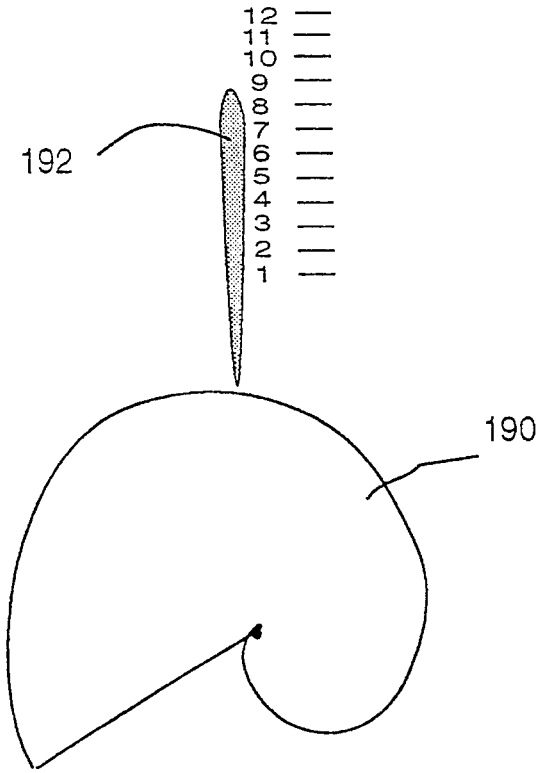

Another pair of similar devices are depicted in FIGS. 20*a* and 20*b*. Here rotatable time indicator plate 190 is dimensioned with a monotonically increasing effective radius. A slidable time indicator member 192 slides up as plate 190 rotates clockwise, displaying different times, as on a scale attached to the support frame. When plate 190 completes a full revolution indicator member 192 drops to its starting position and then slowly begins to rise again with rotation of plate 190.

In the embodiment of FIG. 20*a* plate 190 include hour markings and the scale includes indications of minutes. In the version of FIG. 20*b* plate 190 includes no markings and the hours can be read off from the scale.

Figure 21:
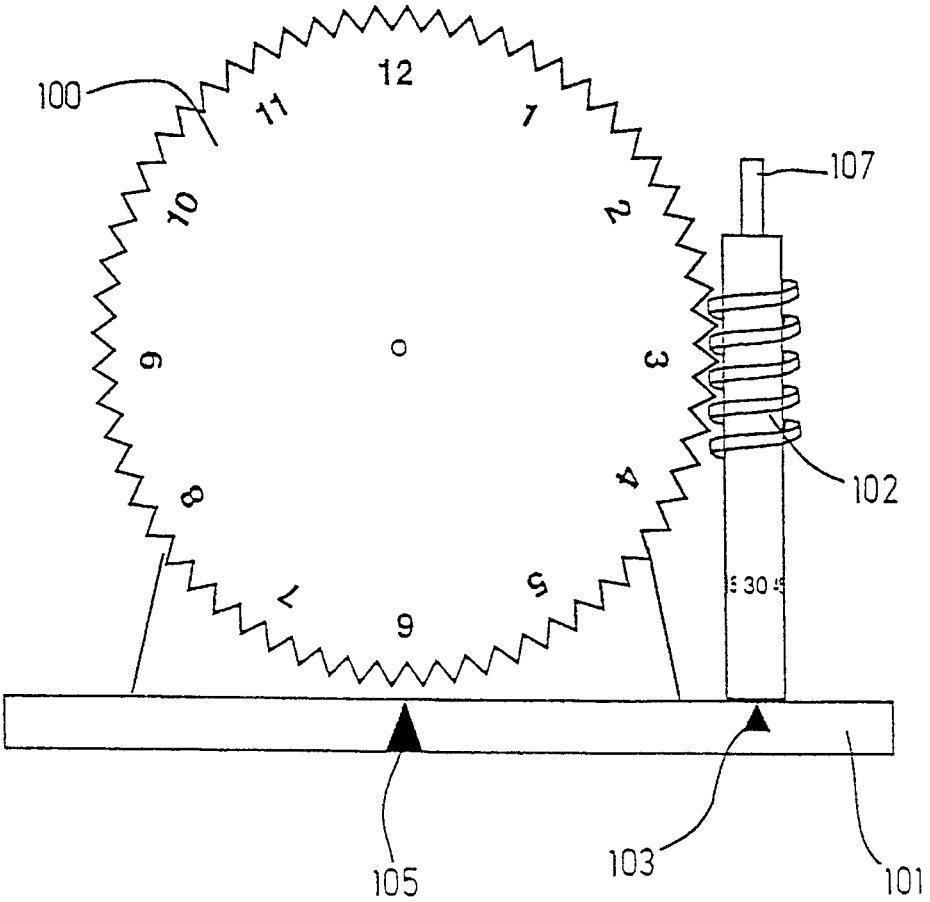
FIG. 21 is a front view of a clock which utilizes a worm gear.
Figure 22A:
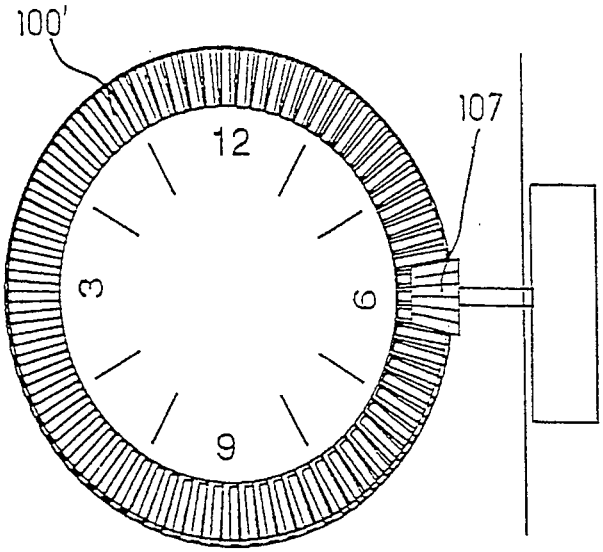
FIGS. 22*a* and 22*b* are front and top views, respectively, of a clock as in FIG. 21 but using bevel gears with a shaft.
Figure 22B:
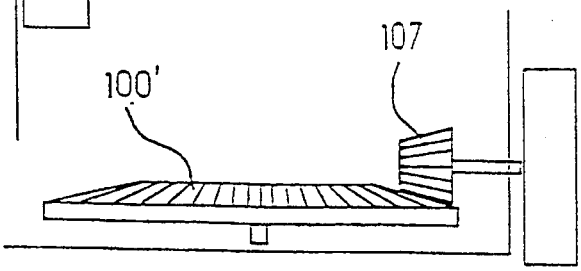

Yet further configurations of a clock according to the present invention is depicted in FIG. 21 and in FIGS. 22*a* and 22*b*. Here a rotatable plate 100 is mounted about a passive central axis. Rotational movement is imparted to plate 100 through use of a worm gear 102 (FIG. 21) or through the use of a beveled plate 100' and a drive gear mounted on a shaft 107 (FIGS. 22*a* and 22*b*).

In the embodiment of FIG. 21, the hours may be read from the point of contact between worm gear 102 and plate 100. Alternatively, an hour marker 105 on frame 101 may be used to perhaps more accurately indicate the hour. The rod which supports worm gear 102 may be marked with minute indications, as shown in FIG. 21 and a minute marker 103 may be used to more readily indicate the minutes. In addition, a secondary rod 107 which is concentric with the rod supporting worm gear 102 but which rotates at a different rate, may be used to indicate the seconds.

Figure 23:
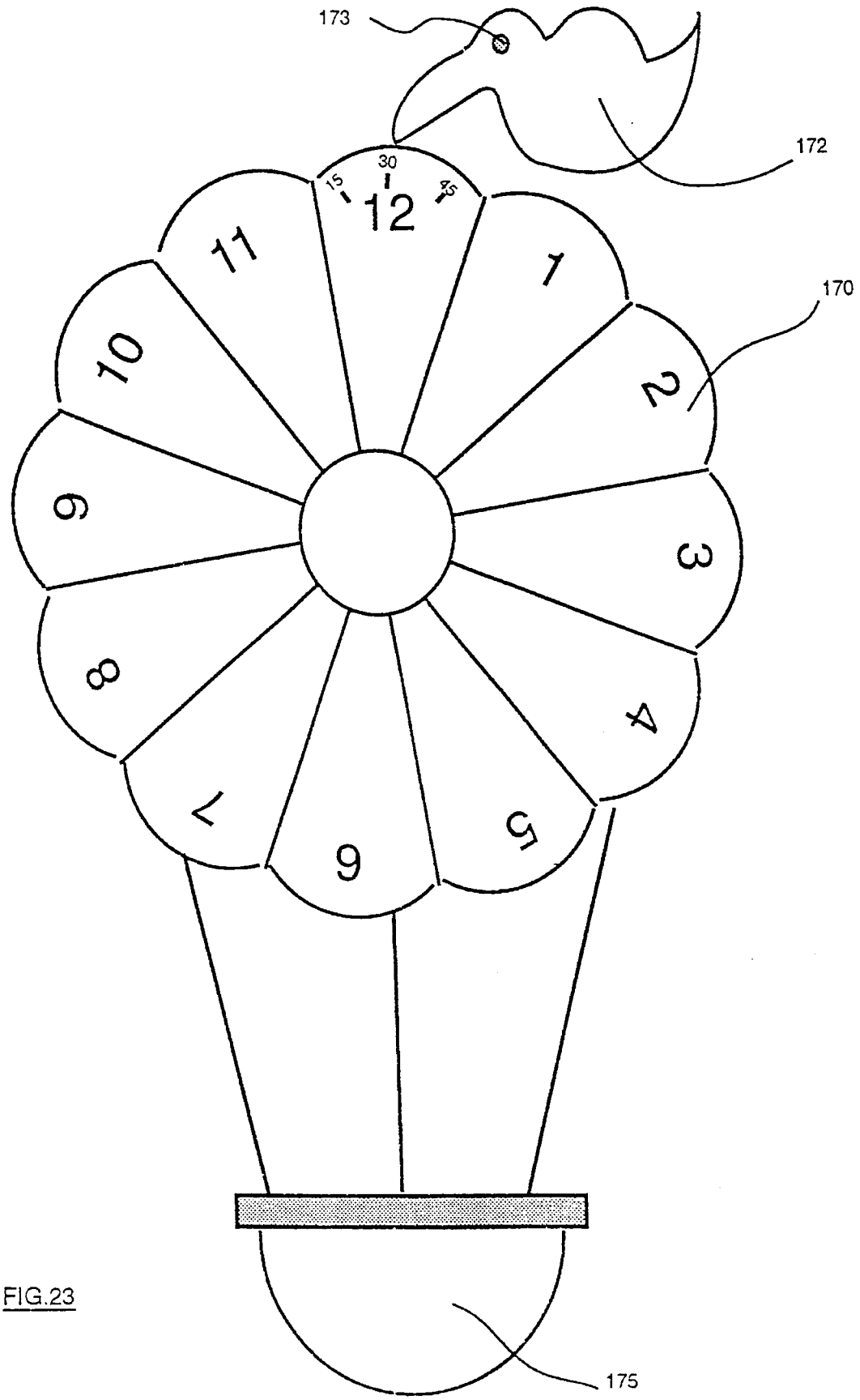
FIG. 23 is a front view of another embodiment of a ratcheted clock.

Shown in FIG. 23 is yet another version of a ratcheted clock. Here rotatable plate 170 is rotated by some suitable means. Pivotable plate 172 (here shown in the shape of a bird) is pivoted about pivot point 173. Markings on plate 170 indicate the hours as well as the minutes. If desired, an appropriately shaped pendulum 175 may be used to enhance the aesthetic appeal of the clock.

While the invention has been described with respect to a limited number of embodiments, it will be appreciated that many variations, modifications and other applications of the invention may be made.

What is claimed is:

1. An apparatus for the display of time, comprising:

(a) a support frame;

(b) a driven worm gear having external teeth, said worm gear being on a primary rotatable rod, said primary rod having a primary rod rotational axis, said rod being mounted on said support frame; and said worm gear rotating about said primary rod rotation axis; and (c) a rigid rotatable plate mounted on said support frame and rotatable about a plate rotational axis, said plate having external teeth about a periphery of said plate, said external teeth of said driven worm gear engaging said external teeth of said plate so as to rotate said plate about said plate rotation axis, said plate featuring markings representing the time, the position of said markings being the sole indication of the time, said primary rod rotational axis and said plate rotational axis being substantially non-parallel and wherein said primary rod features minute indications.

2. The apparatus of claim 1, wherein said support frame includes a support frame time marker.

3. The apparatus of claim 2, wherein said support frame time marker is an hour marker.

4. The apparatus of claims 1, further comprising a secondary rotatable shaft concentric with said primary rotatable, said secondary rod featuring secondary rod time indications.

5. The apparatus of claim 4, wherein said secondary time indications are second indications.

* * * * *